US005145288A

United States Patent [19]

Borcherdt

[11] Patent Number: 5,145,288

[45] Date of Patent: Sep. 8, 1992

[54] MORTARLESS RETAINING WALL

[76] Inventor: D. Thomas Borcherdt, Box 39D, R.R. 1, Tusket, Nova Scotia, Canada, B0W 3M0

[21] Appl. No.: 582,658

[22] Filed: Sep. 13, 1990

[51] Int. Cl.[5] ..... E02D 29/02

[52] U.S. Cl. ..... 405/284; 405/286; 52/441

[58] Field of Search ..... 405/262, 284, 285, 286, 405/287, DIG. 12; 52/169.1, 426, 442; 411/461–467

[56] References Cited

U.S. PATENT DOCUMENTS

| | | | |
|---|---|---|---|
| 858,933 | 7/1907 | White | 52/426 |
| 1,347,459 | 7/1920 | Hand | 405/285 X |
| 1,377,424 | 5/1921 | Milliken | 411/461 X |
| 2,261,510 | 11/1941 | Atcheson | 52/442 |
| 3,196,581 | 7/1965 | Castelli | 52/442 |
| 3,225,643 | 12/1965 | Couch | 411/461 |
| 3,374,589 | 3/1968 | Neal | 52/442 |
| 4,060,954 | 12/1977 | Liuzza | 52/169.1 X |
| 4,235,148 | 11/1980 | Menge | 411/466 |
| 4,244,155 | 1/1981 | Swiger | 52/442 |
| 4,266,890 | 5/1981 | Hilfiker | 405/286 |
| 4,604,843 | 8/1986 | Ott et al. | 52/426 |
| 4,661,023 | 4/1987 | Hilfiker | 405/284 X |
| 4,914,876 | 4/1990 | Forsberg | 405/286 X |

*Primary Examiner*—Randolph A. Reese
*Assistant Examiner*—Arlen L. Olsen
*Attorney, Agent, or Firm*—R. Craig Armstrong

[57] ABSTRACT

The invention provides a simple, economical and effective means of constructing a retaining wall from conventional concrete building blocks. A sheet member is provided, having protrusions which locate in the hollow core portions of the blocks to couple the blocks together. Where a tie-back is desired, the sheet member has an anchoring portion which extends back into the backfill to anchor the wall thereto. In one embodiment, the sheet member is plastic or other non-corrosive substance, with a matrix of dome-like protrusions. In another embodiment, the sheet member can be of a mesh-like construction. In another embodiment, the anchoring portion can be corrugated, with the corrugations running parallel to the wall. In another embodiment, the sheet member can be a sheet of stainless or galvanized steel or the like, or other suitable material, with tab portions stamped therefrom to form the protrusions.

4 Claims, 8 Drawing Sheets

MORTARLESS RETAINING WALL

BACKGROUND OF THE INVENTION

This invention relates to retaining walls, and specifically to structures which facilitate constructing a retaining wall from conventional concrete building blocks.

The permissible height of a concrete block wall without tie-backs depends on the mass of the wall, the backfill material, and other known determinants of similar retaining walls made from similar elements but having different types of interlocks, such as protrusions or grooves cast into the blocks themselves. Usually this type of wall is limited in height 4 to 6 times the depth of the wall element.

With tie-backs, a concrete block wall can usually be built to a height equal to or greater than the length of the tie backs, if the ties and their connection to the face blocks is strong enough.

SUMMARY OF THE INVENTION

It is an object of the invention to provide a simple, economical and effective means of constructing a retaining wall from conventional concrete building blocks.

It is a further object of certain embodiments of the invention to provide for adequate tie-backs, i.e. anchoring of the wall to the backfill.

In the invention, a sheet member is provided to couple standard concrete building blocks to construct a mortarless retaining wall. The sheet member has protrusions which locate in the hollow core portions of the blocks to couple the blocks together, and where a tie-back is desired, an anchoring portion which extends back into the backfill to anchor the wall thereto.

In one embodiment, the sheet member is plastic or other non-corrosive substance, with a matrix of dome-like protrusions.

In another embodiment, the sheet member can be of a mesh-like construction.

In another embodiment, the anchoring portion can be corrugated, with the corrugations running parallel to the wall.

In another embodiment, the sheet member can be a sheet of stainless or galvanized steel or the like, or other suitable material, with tab portions stamped therefrom to form the protrusions.

The protrusions need not be dome-shaped as mentioned above, but may be any shape suitable to engage the hollow interior of the blocks.

Further features of the invention will be described or will become apparent in the course of the following detailed description.

BRIEF DESCRIPTION OF THE DRAWINGS

In order that the invention may be more clearly understood, alternative embodiments thereof will now be described in detail by way of example, with reference to the accompanying drawings, in which.

DETAILED DESCRIPTION OF THE PREFERRED EMBODIMENT

Figure 1:
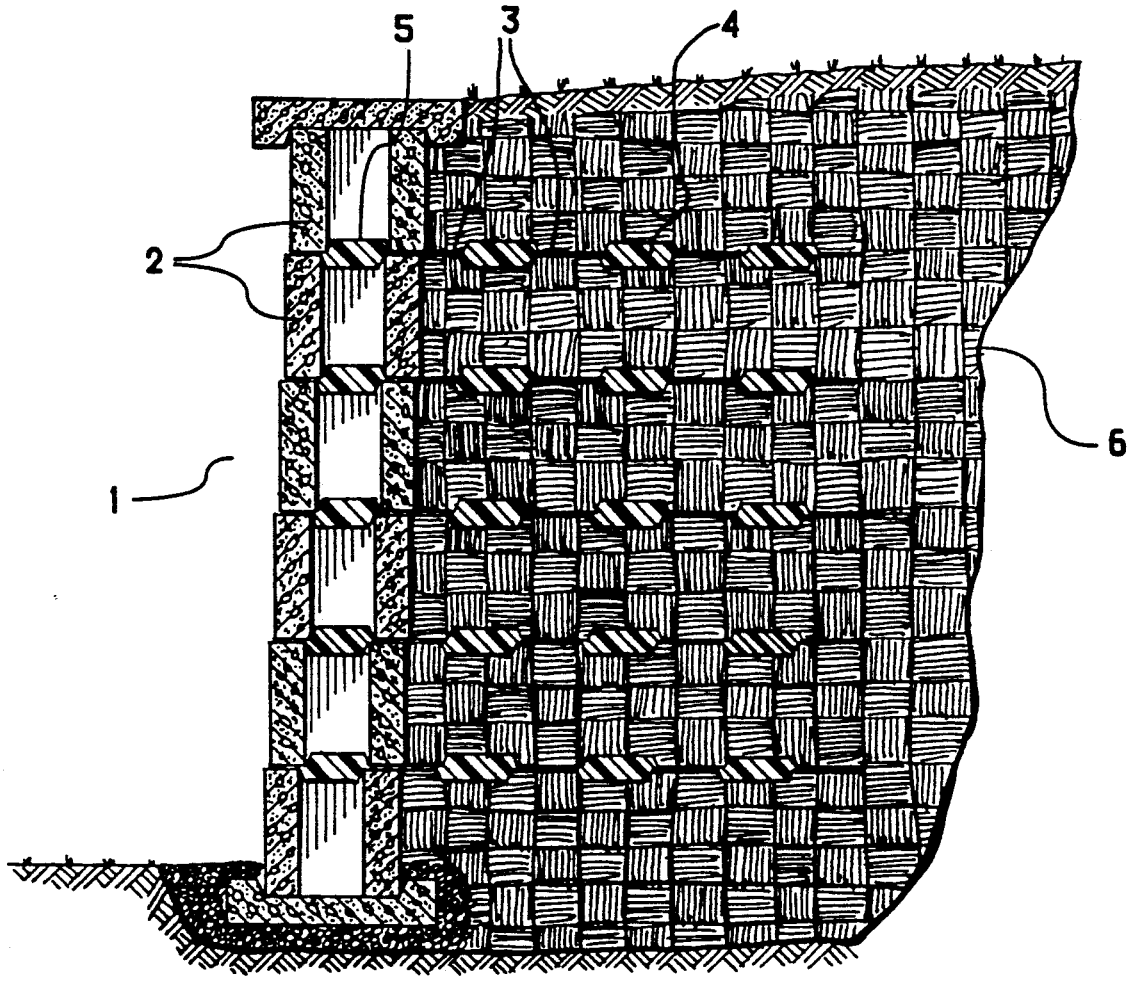
FIG. 1 is a side view of a wall constructed using one embodiment of the invention.

FIG. 1 shows a mortarless retaining wall 1 constructed from conventional concrete building blocks 2, using a plastic (or other non corrosive) sheet member 3 to tie the blocks together. As can be seen more clearly in FIG. 2, the sheet member is essentially a relatively thin sheet or substrate 4 having protrusions 5 which engage in the hollow cores of the blocks. The sheet member should not be too thick, since otherwise it would create to large a gap between blocks stacked on top of each other.

Preferably, especially for higher walls, the substrate 4 extends back into the backfill 6 to interlock with the backfill to form a stable mass, thereby anchoring the wall to the backfill. However, as shown in the upper portion of FIG. 2, the sheet member could be used simply to tie the blocks together, i.e. without any portion of the sheet member extending into the backfill, if anchoring to the backfill was not desired or required. That is, it is possible to make the sheet member with a single row of protrusions that run along the wall and perform the function of spacing and interlocking the blocks but without tie-back. This is generally only suitable for low walls, e.g. not higher than about three to four times depth.

Figure 2:
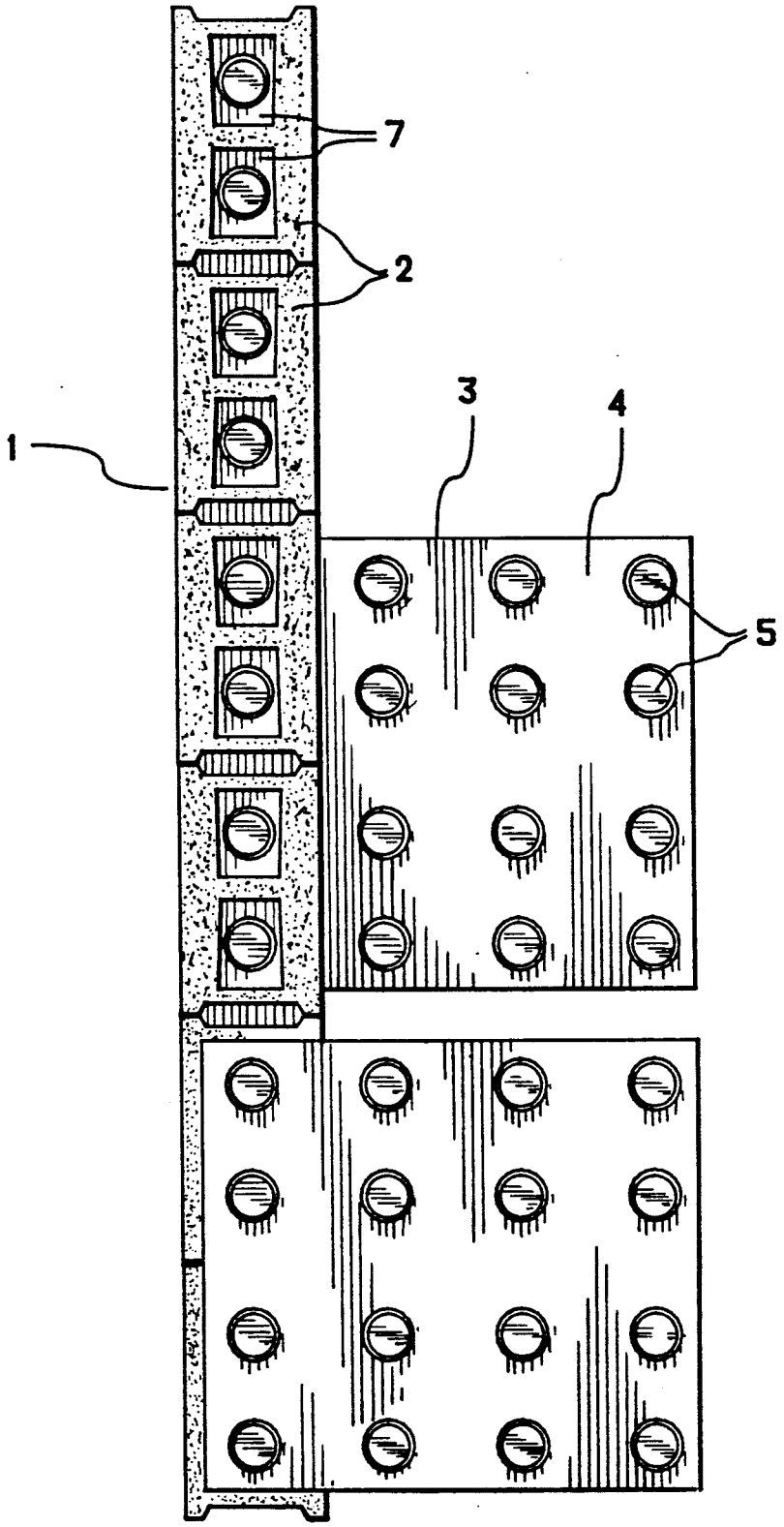
FIG. 2 is a plan view of the wall.

FIG. 2 shows the preferred configuration for the sheet member, i.e. a sheet having sixteen protrusions ($4\times4$), although obviously the configuration could be varied readily. For example, the sheet member could be provided on a roll which is four protrusions wide. The roll could be cut to provide whatever depth of tie-back is required, which would be a function of sheet member material strength, wall height, and backfill type.

Figure 3:
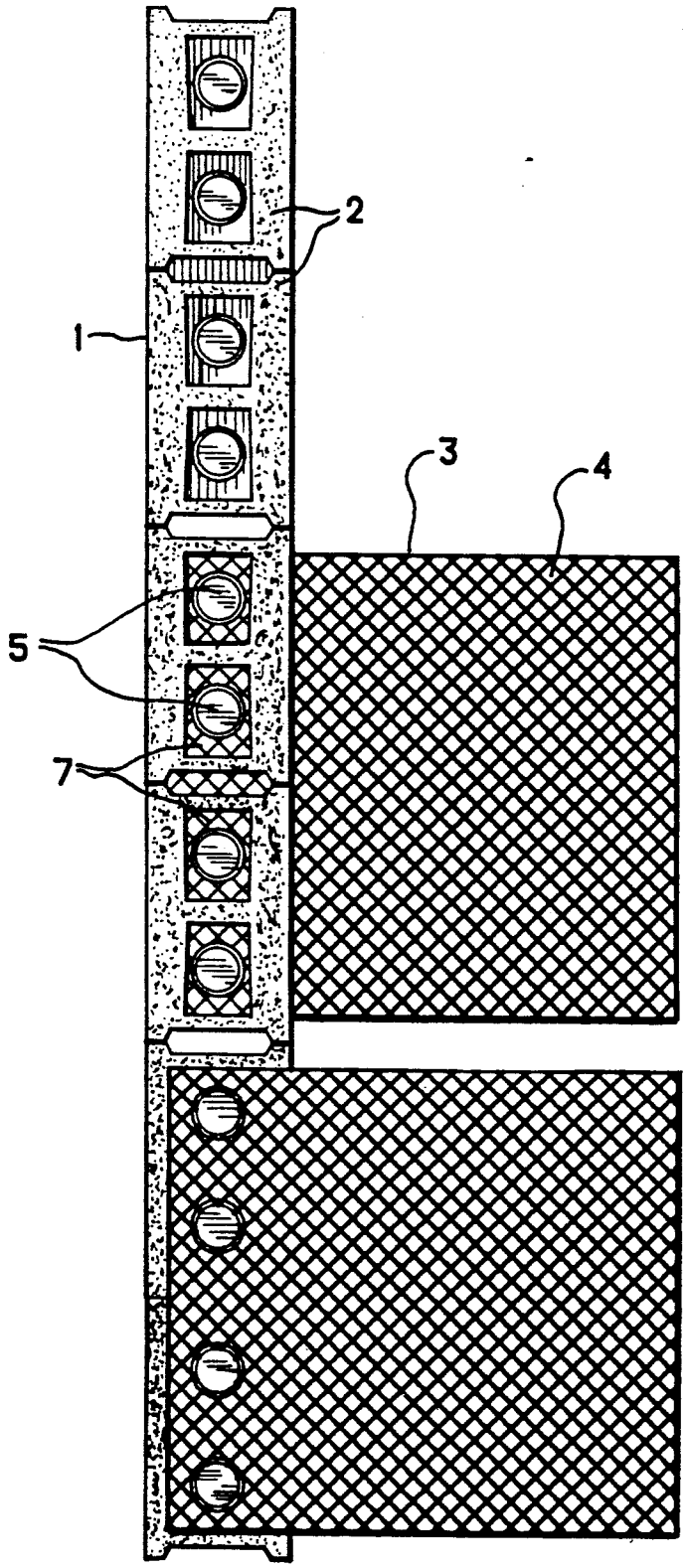
FIG. 3 is a plan view of a wall constructed using an alternative embodiment of the invention.
Figure 4:
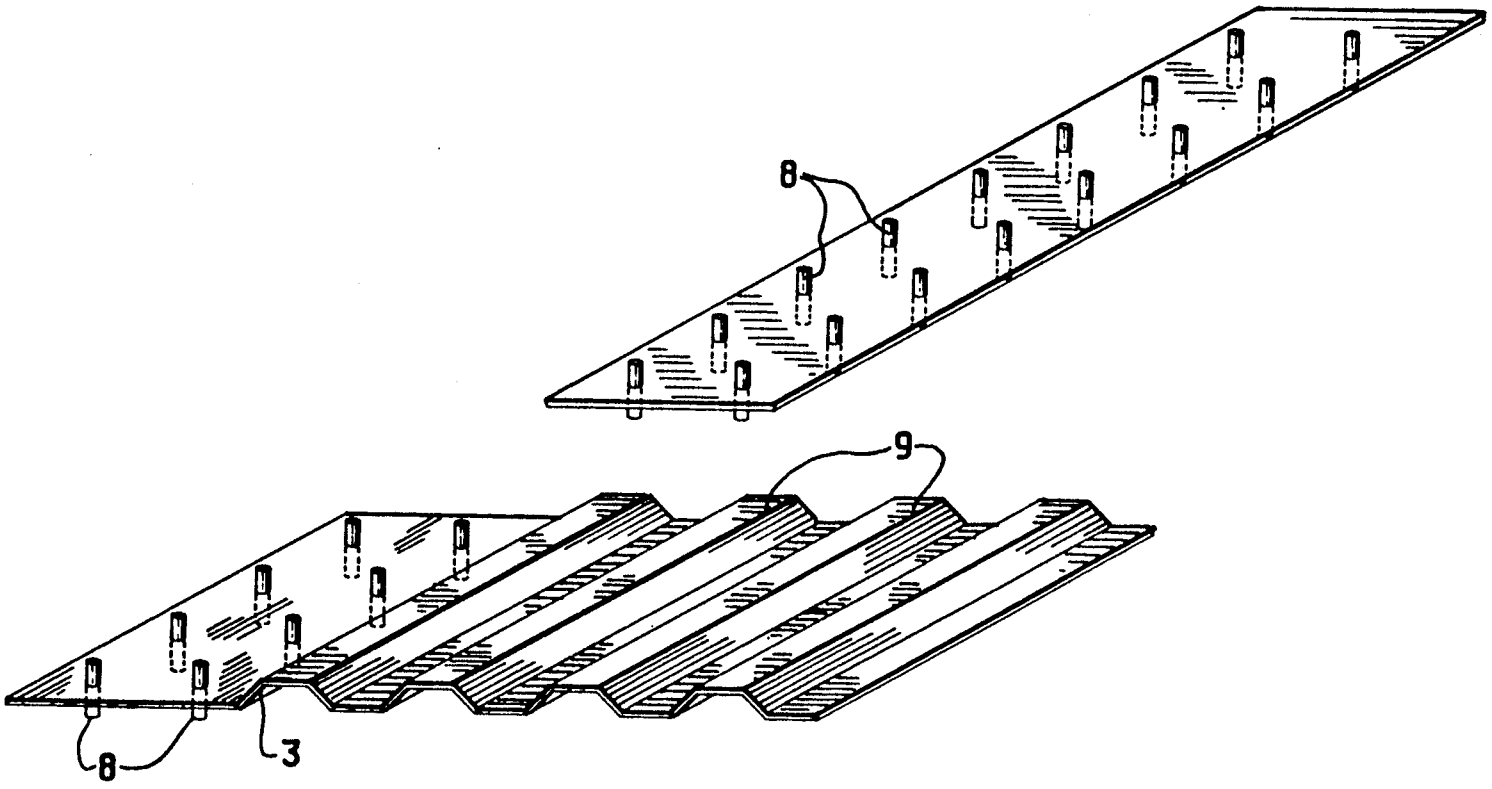
FIG. 4 is a perspective view of another alternative embodiment of the invention.
Figure 5:
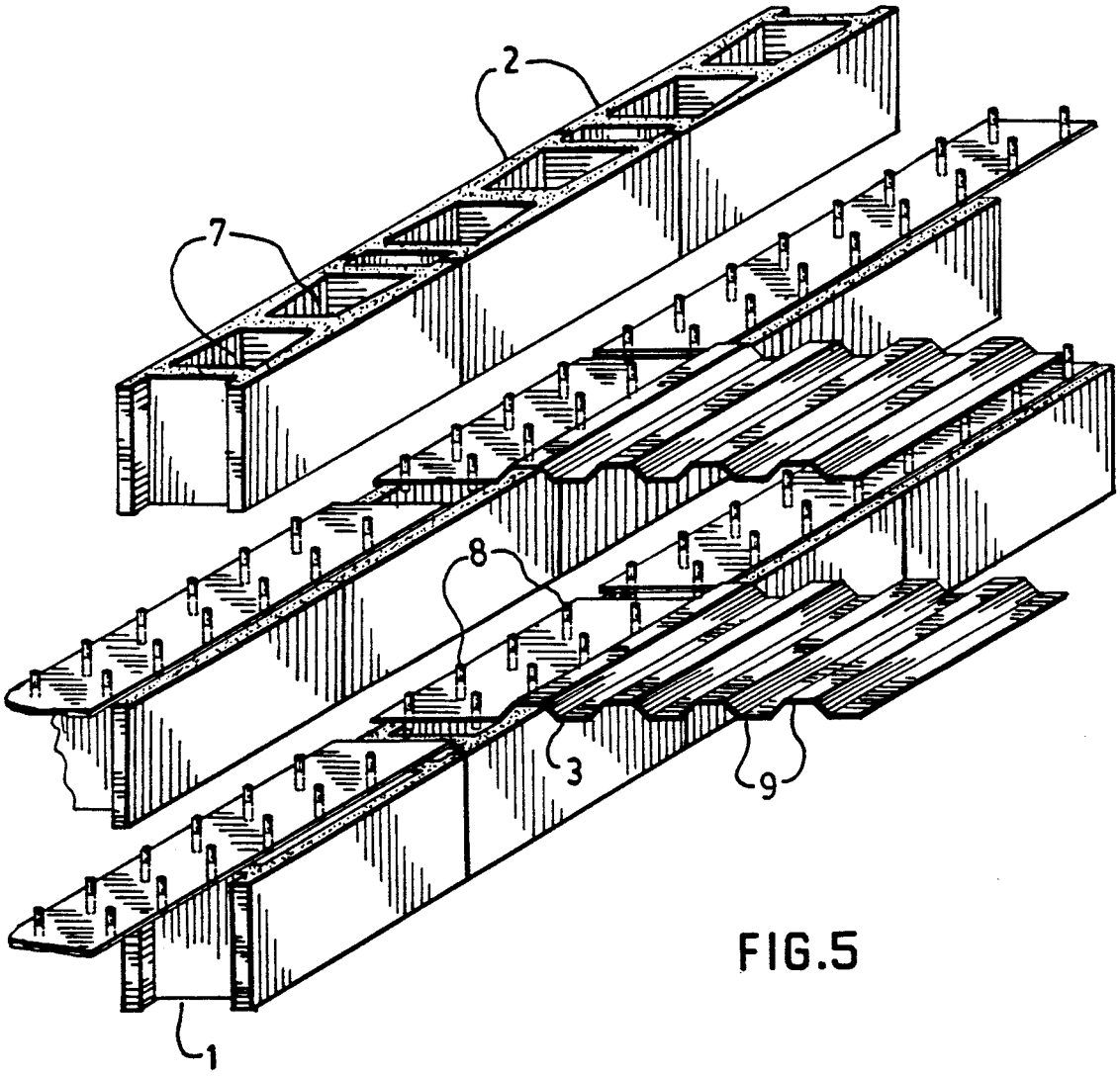
FIG. 5 is a perspective view of a wall constructed using the alternative embodiment of FIG. 4.

The shape and size of the individual protrusions 5 is not critical. All that is essential is that the size and shape be sufficient to fit into the hollow core areas 7 with relatively little play. The protrusions should engage both the block below and the block above so as to prevent them from moving relative to one another. The spacing of the protrusions obviously must correspond to the spacing of the cores for the particular block being used. The protrusions can be generally circular, either cylindrical or slightly tapered, as shown in FIGS. 1–3, or could be any other suitable shape. For example, they could be in the form of pins 8 projecting from the sheet member, as shown in FIGS. 4 and 5. The round shape does somewhat simplify problems of matching different block cores.

As seen in FIG. 3, the anchoring to the backfill need not be provided by protrusions. Instead, the sheet member material could a mesh such that the backfill material would interlock with it to provide stability, or any other suitable shape or material to provide some anchoring. The mesh may be quite economical to produce.

As seen in FIGS. 4 and 5, the anchoring or tie-back portion of the sheet member may have corrugations formed therein. Plastic or other non-corrosive material is preferred. Stainless or galvanized steel could be used.

One additional variation, which can be seen in FIG. 1, is that by offsetting the protrusion on the top of the sheet member from the protrusion on the underside of the sheet member, in the direction back into the hill, a wall can be constructed which will automatically be inclined into the hill being retained.

Although intended to provide a means of making a mortarless wall, mortar could be used if desired to fill the cores of those concrete blocks in the face wall which engage the tie back interlocks, to add strength to the face wall. This mortar could form a bond with the protrusions to further decrease the likelihood of the tie back from pulling out of the joint.

Figure 6:
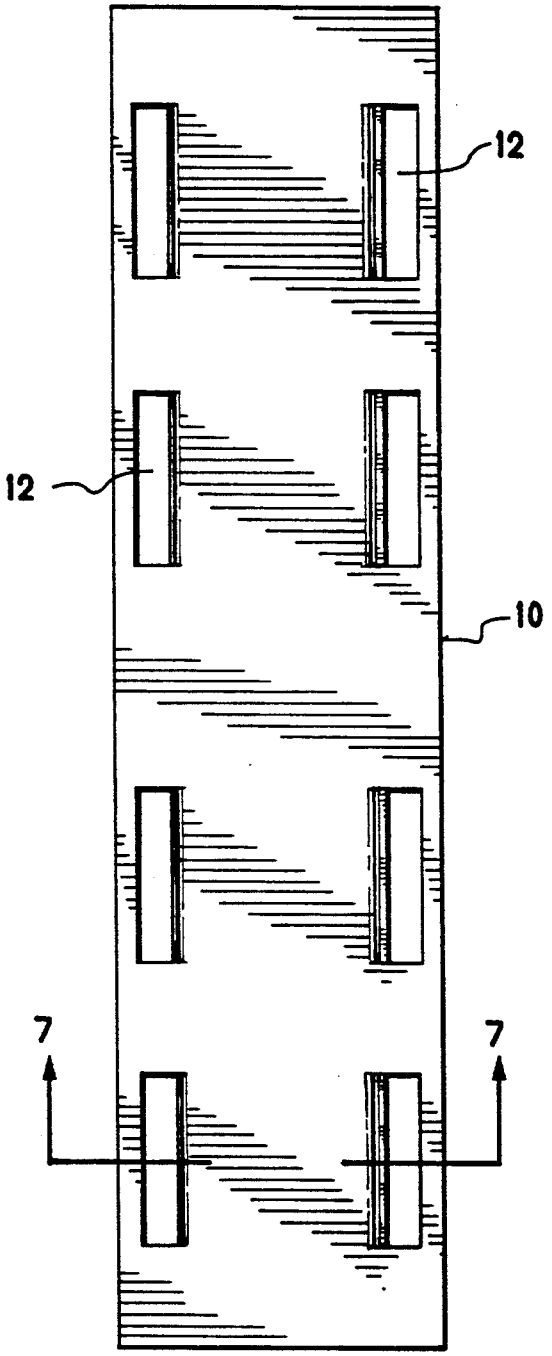
FIG. 6 is a top view of a "runner" version of the invention.
Figure 7:
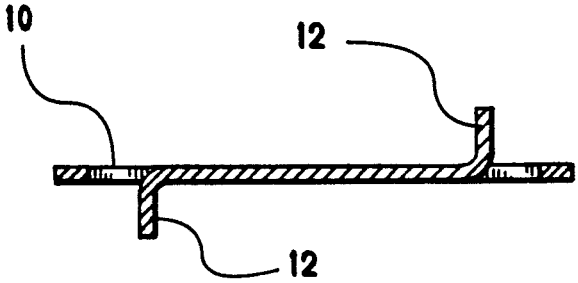
FIG. 7 is section A—A from FIG. 6.
Figure 8:
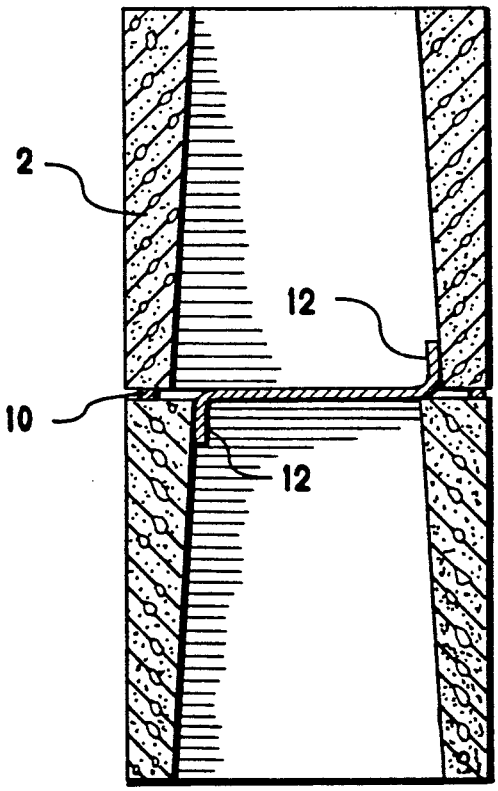
FIG. 8 is a cross-section of a wall using the "runner" version of the invention.

In the version illustrated in FIGS. 6–8, a stamped steel runner 10 is provided. Tabs 12 are stamped upwardly and downwardly from the runner to fit into the hollow portions of the blocks. Twenty gauge galvanized or stainless steel is planned.

Figure 9:
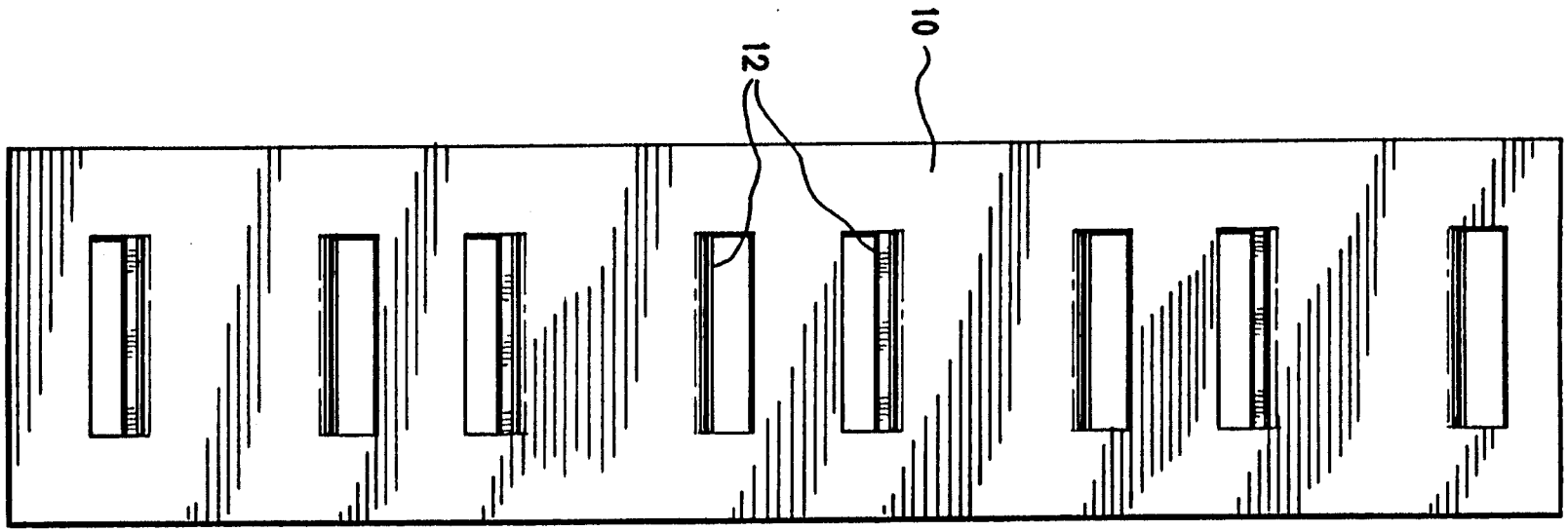
FIG. 9 is a top view of a tie-back version of the invention, similar in principle to the FIG. 6 embodiment.
Figure 10:
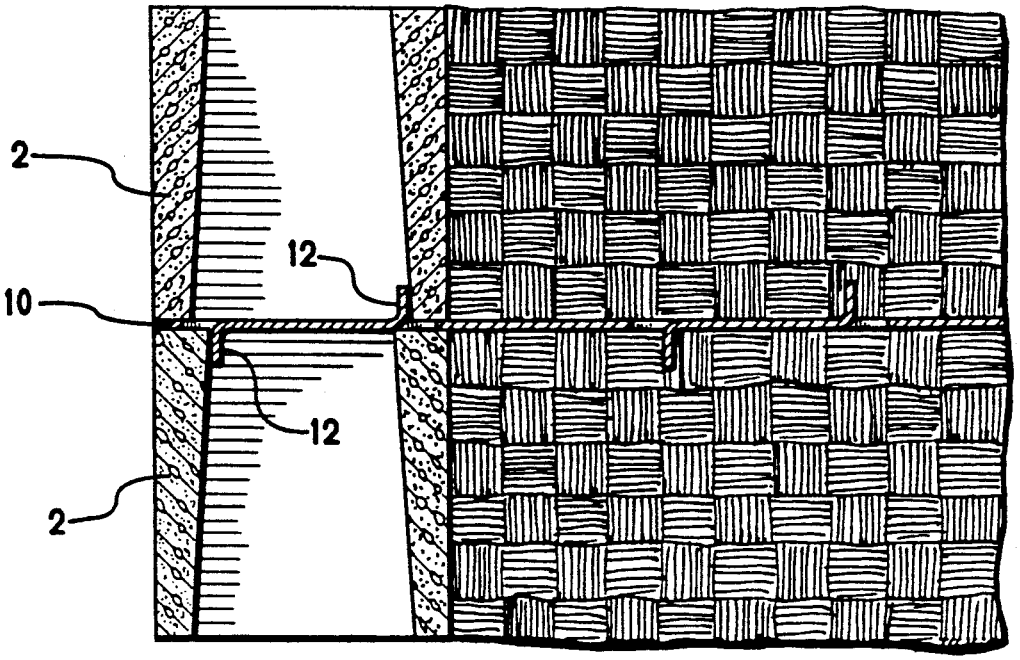
FIG. 10 is a cross-section of a wall using the FIG. 9 version of the invention.

The version illustrated in FIGS. 9 and 10 is similar, but the tabs 12 are oriented such that the runner is intended to run into the backfill area to provide a tie-back.

Figure 11:
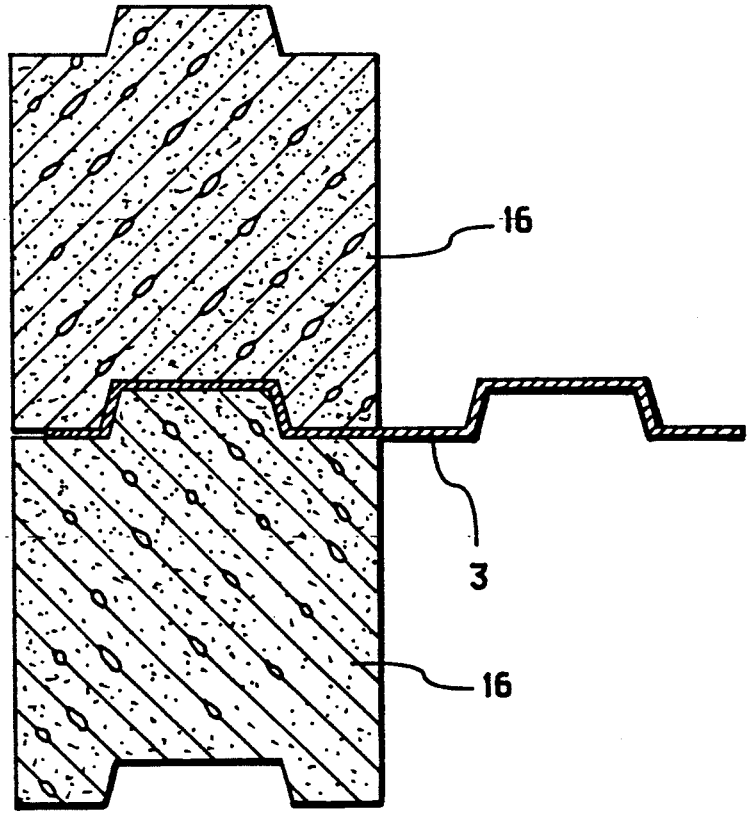
FIG. 11 is a cross-section of a wall using yet another alternative embodiment of the invention.

The version illustrated in FIG. 11 is another embodiment, having a corrugated shape, the corrugated shape matching the shape of the special block 16.

It will be appreciated that the above description relates to the preferred embodiment by way of example only. Many variations on the invention will be obvious to those knowledgeable in the field, and such obvious variations are within the scope of the invention as described and claimed, whether or not expressly described.

What is claimed as the invention is:

1. A device for use in building a wall from hollow-core concrete blocks, where said hollow cores in said blocks are defined by generally upright front, back and side inner surfaces and where said blocks have substantially co-planar flat front and rear bottom surfaces, said device comprising a thin metal planar member placed between horizontal rows of aid concrete blocks with said front and rear bottom surfaces of said concrete blocks resting thereon, and having integral placement projections means from either side thereof for engaging one or more of said upright inner surfaces of said hollow cores of said blocks so as to prevent said blocks from moving with respect to each other in a direction away from the plane of said wall, in which said placement projections means are tabs defined by a generally U-shaped cut made in said metal planar member, with the metal within said U-shape being bent away from said planar member at a substantial angle from said planar member, and an integral extension of said thin planar member comprising ground engaging projection means extending from said extension, to assist in anchoring said extension in a backfilled area.

2. A device as recited in claim 1, in which said thin planar member is arranged as a runner strip adapted to run horizontally between rows of blocks, and in which said tabs are stamped therefrom parallel to the long dimension of said strip.

3. A device as recited in claim 1, in which said thin planar member is arranged as a strip adapted to run from a position between rows of blocks back into a backfilled area behind said wall to thereby assist in anchoring said wall, and in which said tabs are stamped therefrom at right angles to the long dimension of said strip.

4. A device as recited in claim 3, in which said portion of said strip adapted to run into said backfilled area is also provided with said stamped tabs, thereby assisting in anchoring said portion in said backfilled area.

* * * * *